United States Patent [19]

Kadija

[11] 4,416,757

[45] Nov. 22, 1983

[54] COATED THERMOPLASTIC POLYMER DIAPHRAGMS AND A METHOD FOR THEIR PREPARATION

[75] Inventor: Igor V. Kadija, Cleveland, Tenn.

[73] Assignee: Olin Corporation, New Haven, Conn.

[21] Appl. No.: 972,559

[22] Filed: Dec. 22, 1978

[51] Int. Cl.[3] ..... C25B 13/08

[52] U.S. Cl. ..... 204/252; 204/296

[58] Field of Search ..... 204/296, 295

[56] References Cited

U.S. PATENT DOCUMENTS

| | | | |
|---|---|---|---|
| 3,838,104 | 9/1974 | Hayashi et al. | 526/243 |
| 3,849,521 | 11/1974 | Kirimoto et al. | 260/900 |
| 3,853,720 | 12/1974 | Korach et al. | 204/98 |
| 3,997,507 | 12/1976 | Kirimoto et al. | 526/287 |
| 4,062,753 | 12/1977 | Falvo | 204/266 |
| 4,100,113 | 7/1978 | McCain | 204/296 X |
| 4,115,240 | 9/1978 | Asawa et al. | 204/296 |
| 4,124,458 | 11/1978 | Moeglich | 204/98 |
| 4,136,237 | 1/1979 | Takahashi et al. | 521/27 |
| 4,178,218 | 12/1979 | Seko | 204/98 |

FOREIGN PATENT DOCUMENTS 2300144 3/1976 France .

OTHER PUBLICATIONS

Asahi Guard trade bulletin, Dec. 1974 pub. by Asahi Glass Co.

Umaba, Chem. Econ. & Engineering Rev. vol. 10, No. 12, pp. 15–19 12/78.

Kirk-Othmer, Encyc. of Chemical Tech. 2nd Ed., vol. 22 p. 145 (1970).

*Primary Examiner*—F. Edmundson

*Attorney, Agent, or Firm*—James B. Haglind; Donald F. Clements

[57] ABSTRACT

An electrolyte permeable diaphragm for use in the electrolysis of aqueous solutions of ionizable compounds in electrolytic cells is comprised of a thermoplastic polymer coated with a fluorochemical resin water repellent.

The diaphragms are physically and chemically stable and possess suitable ion and liquid transfer properties.

16 Claims, No Drawings

COATED THERMOPLASTIC POLYMER DIAPHRAGMS AND A METHOD FOR THEIR PREPARATION

This invention relates to diaphragm-type electrolytic cells for the electrolysis of aqueous solutions of ionizable compounds. More particularly, this invention relates to novel diaphragms for electrolytic diaphragm cells, and a method for preparing them.

In an electrolytic diaphragm cell, the diaphragm represents the cell component which selectively permits the passage of ions and liquids from the anode compartment to the cathode compartment. Commercial diaphragm cells for the electrolysis of alkali metal chloride solutions to produce gaseous chlorine and alkali metal hydroxide solutions employ large quantities of diaphragm materials. Relatively few materials are known which can survive the hostile environment of a chlorine cell for sufficiently long periods of time to be used as diaphragms. One group of materials which are resistant to this environment are thermoplastic polymers such as polyolefins or polyarylene sulfides. These materials, however, do not possess sufficient transfer properties to serve as diaphragms. For example, the polyolefins are hydrophobic materials with little ability to permit the passage of selected ions or liquids and, when used as diaphragms, require high cell voltages while operating at low current efficiencies. Electrical resistance is increased substantially as a result of the water-repelling properties of these materials.

Therefore there is a need for diaphragms comprised of materials which are durable and which also possess suitable ion and liquid transfer properties.

It is an object of the present invention to provide a diaphragm having suitable stability and transfer properties when employed in the electrolysis of aqueous solutions of ionizable compounds.

Another object of the present invention is to provide a method for the preparation of these diaphragms.

An additional object of the present invention is to provide an electrolyte permeable diaphragm for the electrolysis of aqueous solutions of ionizable compounds.

A further object of the present invention is to provide an electrolyte permeable diaphragm having efficient separation properties at reduced costs for energy.

These and other objects of the invention are accomplished by an electrolyte permeable diaphragm for use in electrolytic processes comprised of a thermoplastic polymer coated with a fluorochemical resin water repellent.

Thermoplastic polymers which are suitable for use in preparing the electrolyte permeable diaphragms of this invention include those thermoplastic polymers which are normally not satisfactory as diaphragms in electrolytic cells, until coated, in accordance with the process of this invention. Generally, polyolefins which are polymers of olefins having from about 2 to about 6 carbon atoms in the primary chain as well as their chloro- and fluoro-derivatives are thermoplastic polymers of this type.

Examples of these thermoplastic polymers include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride and copolymers of ethylene-chlorotrifluoroethylene.

Preferred olefins include the chloro- and fluoro-derivatives such as polytetrafluoroethylene, fluorinated ethylene-propylene (FEP), polychlorotrifluoroethylene, polyvinyl fluoride, and polyvinylidene fluoride.

Also suitable as thermoplastic polymers are polyarylene compounds including polyphenylene, polynaphthylene and polyanthracene derivatives. For example, polyarylene sulfides such as polyphenylene sulfide or polynaphthylene sulfide can be used in preparing diaphragms of the present invention. Polyarylene sulfides are well known compounds whose preparation and properties are described in the *Encyclopedia of Polymer Science and Technology* (Interscience Publishers) Vol. 10, pages 653–659. In addition to the parent compounds, derivatives having chloro-, fluoro-, or alkyl substituents may be used such as poly(perfluorophenylene) sulfide and poly(methylphenylene) sulfide.

Mixtures of polyarylene compounds and polyolefin compounds may be used in the diaphragm of the present invention. For example, polyarylene sulfides may be mixed with polyolefins such as polytetrafluoroethylene, polychlorotrifluoroethylene, or polyvinylidene fluoride in any suitable proportion. Preferred proportions are those in which the polyarylene sulfide is from about 30 to about 90 percent by weight of the mixture.

When employed as diaphragms in electrolytic cells, the thermoplastic polymers may be used in any suitable form such as a film, sheet, or fabric. The polymer forms have a pore size in the range of from about 0.1 to about 80, and preferably from about 5 to about 40 microns.

Diaphragms suitable for use in electrolytic processes are obtained by coating these polymers with water repellents comprised of a fluorochemical resin. The water repellents used include polymeric materials which are commercially available. Examples of suitable water repellents include fluorochemical resins sold under the tradename "Asahi Guard" ® by the Asahi Glass Company and "Scotchguard" ® by the 3M Company. The resins are polymers or copolymers derived from a fluoroalkyl monomer where the alkyl group has from about 3 to about 15 carbon atoms. Preferred fluoroalkyl monomers are those which are esters of unsaturated acids such as acrylic acid or methacrylic acid. Suitable examples include:

$CF_3(CF_2)_7(CH_2)_{11}OCOCH{=}CH_2$,
$CF_3(CF_2)_4CH_2OCOC(CH_3){=}CH_2$,
$(CF_3)_2CF(CF_2)_6(CH_2)_3OCOCH{=}CH_2$,
$(CF_3)_2CF(CF_2)_{10}(CH_2)_3OCOCH{=}CH_2$,
$CF_3(CF_2)_6(CH_2)_2OCOC(CH_3){=}CH_2$,
$(CF_3)_2CF(CF_2)_6(CH_2)_2OCOCH{=}CH_2$,
$CF_3(CF_2)_7SO_2N(C_3H_7)(CH_2)_2OCOCH{=}CH_2$,
$CF_3(CF_2)_7(CH_2)_4OCOCH{=}CH_2$,
$CF_3(CF_2)_7SO_2N(CH_3)(CH_2)_2OCOC(CH_3){=}CH_2$,
$CF_3(CF_2)_7(CH_2)_3COOCH{=}CH_2$,
$(CF_3)_2CF(CF_2)_6CH_2CH(OH)CH_2OCOCH{=}CH_2$,
$(CF_3)_2CF(CF_2)_6CH_2CH(OCOCH_3)OCOC(CH_3){=}CH_2$,
$CF_2ClCF_3CF(CF_2)_7CONHCOOCH{=}CH_2$,
$H(CF_2)_{10}CH_2OCOCH{=}CH_2$, and
$CF_2Cl(CF_2)_{10}CH_2OCOC(CH_3){=}CH_2$.

These fluoroalkyl monomers are preferably copolymerized with unsaturated compounds such as vinyl ethers; esters including acrylates, methacrylates and crotonates; amides such as methylolacrylamide, methylolmethacrylamide, diacetoneacrylamide or diacetonemethaacrylamide; or halides such as vinyl chloride, chloroprene or 2-chloro-1,3-butadiene.

The copolymers are prepared by known polymerization reactions such as bulk polymerization, solution polymerization, suspension polymerization, emulsion polymerization, radiation polymerization and photopolymerization. Suitable water repellent fluorochemical resins may be produced, for example, by the processes described in U.S. Pat. No. 3,838,104, issued Sept. 24, 1974, to T. Hayashi et al; U.S. Pat. No. 3,849,521, issued Nov. 19, 1974, to K. Kirimoto et al; or U.S. Pat. No. 3,997,507, issued Dec. 14, 1976, to K. Kirimoto et al.

The thermoplastic polymer may be coated with the water repellent in any suitable manner. For example, the water repellents are available as solutions, emulsions, or aerosols and may be applied to the diaphragm material by methods such as painting, rolling, dipping, or spraying.

A sufficient amount of water repellent is applied which will impart to the thermoplastic polymer those ion and liquid transfer properties which will enable the thermoplastic polymer to serve as a diaphragm. Generally, this amount is present when the thermoplastic polymers which are normally opaque, tend to become translucent. Suitable amounts include from about 0.5 to about 15, and preferably from about 2 to about 10 grams of water repellent per square meter of diaphragm material. The water repellent may be applied as one or several coats to achieve the desired result.

Following application of the water repellent, the coated polymer is maintained at a temperature in the range from about ambient to about 200° C., and preferably from about 100° to about 150° C. for a sufficient time to evaporate any solvent present and solidify the coating. Generally the time required, at the preferred temperature range to evaporate solvent ranges from about 2 to about 10, and preferably from about 3 to about 5 minutes. However, shorter or longer periods may be employed if desired.

Before installing the diaphragm in an electrolytic cell, it is preferred to treat the diaphragm with a solution of the electrolyte or an electrolytic product which is used or produced in the cell. For example, where the diaphragm will be used in a cell for the electrolysis of an alkali metal chloride to produce chlorine and an alkali metal hydroxide, the diaphragm is immersed in a solution of the alkali metal hydroxide or a cell liquor containing a mixture of the hydroxide with the alkali metal chloride. This solution is preferably maintained at a temperature which corresponds to that present during operation of the electrolytic cell in which it will be used.

After treating the diaphragm in the above manner, the coated diaphragm is ready for installation in an electrolytic cell.

Electrolytic cells in which the diaphragms of the present invention may be used include those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal or graphite anodes, a cathode assembly having a plurality of foraminous metal cathodes with the novel diaphragm separating the anodes from the cathodes. Suitable electrolytic cells which utilize the novel diaphragms of the present invention include, for example, those types illustrated by U.S. Pat. Nos. 1,862,244; 2,370,087; 2,987,463; 3,247,090; 3,477,938; 3,493,487; 3,617,461; and 3,642,604.

Diaphragms of the present invention may also be suitably used, for example, in cells which electrolyze alkali metal hydroxides to produce hydrogen and oxygen.

The electrolyte permeable diaphragms of the present invention are illustrated by the following examples without any intention of being limited thereby. All parts and percentages are by weight unless otherwise specified.

EXAMPLE I

An opaque porous sheet of polyvinylidene fluoride (2–3 millimeters thick) was sprayed with a fluorochemical resin water repellent (3M Co. Scotchguard FC-4101-16) from an aerosol spray container. The sheet was sprayed with water repellent until it appeared to be translucent. The sprayed section was dried at a temperature of 100° C. for a period of 4 minutes. Prior to installation as a diaphragm, the section was immersed in a 15 percent NaOH solution at 80° C. and kept for about 2 hours. The coated sheet of polyvinylidene fluoride was installed as a diaphragm in an electrolytic cell employing a ruthenium oxide coated titanium mesh anode and a steel mesh cathode. The diaphragm was placed against the surface of the cathode and spaced apart from the anode a distance of about 7 millimeters. Sodium chloride brine having a concentration of about 300 grams of NaCl was fed to the anode compartment. Current was passed through the brine at a density of 2.0 kiloamps per square meter of anode surface. The cell operated at a voltage of 3.2–3.3 volts to produce a cathode liquor containing 115–120 grams of NaOH and 170–180 grams of NaCl at a current efficiency of about 60 percent.

COMPARATIVE EXAMPLE A

The procedure of Example 1 was repeated with the sole exception being that the sheet of polyvinylidene fluoride was not treated with the fluorochemical resin water repellent. Electrolysis using the uncoated diaphragm required a cell voltage of 4.2–4.3 volts to produce a caustic liquor containing 6 grams per liter of NaOH at a current efficiency below 10 percent.

Example 1 illustrates the surprising improvement in performance for the novel diaphragm of the present invention where current efficiency was increased over 6 fold and a cell liquor produced containing significant concentrations of sodium hydroxide.

EXAMPLE II

A polytetrafluoroethylene sheet about 9 mils thick (Chemplast Inc., Wayne, N.J., Zytex® E606-223, pore size 2–5 microns) was sprayed with a fluorochemical resin water repellent in aerosol form (Asahi Gaurd AG-630). The coated polytetrafluoroethylene was dried at 100° C. for 3–4 minutes. Three additional coats of water repellent were sprayed onto the polytetrafluoroethylene and the sheet dried at 100° C. for about 3 minutes between each successive coat. After the final coat of water repellent was applied, the sheet was dried at 150° C. for a period of 3 minutes. The coated polytetrafluoroethylene was soaked for two hours in a 15 percent NaOH solution whose temperature was maintained at 80° C. The coated polytetrafluoroethyelene sheet was then employed as the diaphragm in the electrolytic cell of Example 1. Cell liquor containing sodium hydroxide in the range of 108–150 grams per liter was produced at a cell voltage of 3.8–4.3 volts and a current efficiency of 85–95 percent.

EXAMPLE III

A sheet of polytetrafluoroethylene about 5 mils thick (Zytex® 846B-122D, pore size 10–20 microns) was coated by using the exact procedure of Example 2. After soaking the coated section in the sodium hydroxide solution in the manner of Example 2, the coated polytetrafluoroethylene was employed as the diaphragm in the cell of Example 1. Sepiolite, a magnesium-containing silicate mineral was admixed with the sodium chloride in amounts sufficient to form a brine containing 5 percent by volume of sepiolite. Electrolysis of the sepiolite-containing brine using the procedure of Example 1 produced a solution of sodium hydroxide (128–150 grams per liter) at a cell voltage of 3.08–3.17 and a current efficiency of 75–86 percent.

EXAMPLE IV

Two coats of Scotchguard FC-4101-16 were applied to a sheet of polytetrafluoroethylene (Zytex E249-122) about 5 mils thick to provide the sheet with a coating of 3 grams per square meter of the fluorochemical resin water repellent. The sheet was dried between each coat at 100° C. for about 3 minutes. After the final drying at 150° C. for 3 minutes, the coated sheet was soaked for 2 hours in a 20% solution of sodium hydroxide at 85° C. The coated sheet was installed as a diaphragm in the cell of Example I in which electrolysis was conducted by the procedure of Example I. Over a period of ten days, a caustic liquor containing an average concentration of 120 grams per liter of NaOH and 175 grams per liter of NaCl was produced at an average current efficiency of 74 percent with the cell voltage averaging 3.9 volts.

COMPARATIVE EXAMPLE B

A polyethylene sheet (Zytex E249-122), uncoated by the fluorochemical resin water repellent of Example IV, was soaked for 24 hours in a 20% NaOH solution. When installed in the cell of Example IV, it was unsuitable as a diaphragm.

EXAMPLE V

The procedure of Example IV was repeated exactly using a polytetrafluoroethylene sheet about 5 mils thick (Zytext H662-123). Electrolysis in the cell produced a caustic liquor having an average concentration of 120 grams per liter of NaOH and 175 grams per liter of sodium chloride. Current efficiency averaged 70% at a cell voltage of 5.8–5.9 volts.

What is claimed is:

1. An electrolyte permeable diaphragm for use in electrolytic processes comprised of a thermoplastic polymer coated with a fluorochemical resin water repellent comprised of a polymer or copolymer of a fluoroalkyl ester of an acid selected from the group consisting of acrylic acid and methacrylic acid, said fluoroalkyl group having from about 3 to about 15 carbon atoms.

2. The diaphragm of claim 1 in which said thermoplastic polymer is a polyolefin compound selected from the group consisting of olefins having from 2 to about 6 carbon atoms and their chloro- and fluoro-derivatives.

3. The diaphragm of claim 2 in which said thermoplastic polymer is coated with said fluorochemical resin water repellent in an amount of from about 0.5 to about 15 grams per square meter of thermoplastic polymer.

4. The diaphragm of claim 3 in which said polyolefin is selected from the group consisting of polytetrafluoroethylene, fluorinated ethylene-propylene, polychlorotrifluoroethylene, polyvinyl fluoride, and polyvinylidene fluoride.

5. The diaphragm of claim 4 in which said thermoplastic polymer is in a form selected from the group consisting of film, sheet, or fabric.

6. The diaphragm of claim 5 in which said thermoplastic polymer is a sheet having a pore size of from about 0.1 to about 80 microns.

7. The diaphragm of claim 6 in which said thermoplastic polymer is coated with said fluorochemical resin water repellent in an amount of from about 2 to about 10 grams per square meter of thermoplastic polymer.

8. The diaphragm of claim 7 in which said thermoplastic polymer is selected from the group consisting of polytetrafluoroethylene and polyvinylidene fluoride.

9. The diaphragm of claim 1 in which said thermoplastic polymer is comprised of a mixture of a polyarylene sulfide with a polyolefin selected from the group consisting of polytetrafluoroethylene, polychlorotrifluoroethylene, and polyvinylidene fluoride.

10. An electrolytic cell for the electrolysis of aqueous solutions of alkali metal chlorides employing the electrolyte permeable diaphragm of claim 2.

11. A process for producing electrolyte permeable diaphragms for use in electrolytic processes which comprises coating a thermoplastic polymer with a fluorochemical water repellent comprised of a polymer or copolymer of a fluoroalkyl ester of an acid selected from the group consisting of acrylic acid and methacrylic acid, said fluoroalkyl group having from about 3 to about 15 carbon atoms.

12. The process of claim 11 in which said thermoplastic polymer is a polyolefin selected from the group consisting of polytetrafluoroethylene, fluorinated ethylene-propylene, polychlorotrifluoroethylene, polyvinyl fluoride and polyvinylidene fluoride.

13. The process of claim 12 in which said coated thermoplastic polymer is maintained at a temperature in the range from ambient to about 200° C. for a sufficient time to evaporate any solvent present.

14. The process of claim 13 in which said thermoplastic polymer is coated with said fluorochemical resin water repellent in an amount from about 0.5 to about 15 grams per square meter of thermoplastic polymer.

15. The process of claim 14 in which said thermoplastic polymer is selected from the group consisting of polytetrafluoroethylene and polyvinylidene fluoride.

16. The process of claim 15 in which said thermoplastic polymer is coated with said fluorochemical resin water repellent in an amount of from about 2 to about 10 grams per square meter of thermoplastic polymer.

* * * * *